US006492020B1

(12) United States Patent
Ahn et al.

(10) Patent No.: US 6,492,020 B1
(45) Date of Patent: Dec. 10, 2002

(54) STAPLE FIBERS PRODUCED BY A BULKED CONTINUOUS FILAMENT PROCESS AND FIBER CLUSTERS MADE FROM SUCH FIBERS

(75) Inventors: John S. Ahn, Kinston, NC (US); Fritz Brakelmann, Hamm (DE); Ilan Marcus, Versoix (CH)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/596,247

(22) Filed: Jun. 16, 2000

Related U.S. Application Data

(60) Provisional application No. 60/139,938, filed on Jun. 18, 1999, now abandoned.

(51) Int. Cl.[7] ..... D01F 6/00

(52) U.S. Cl. ..... 428/359; 428/362; 428/394

(58) Field of Search ..... 428/362, 97, 344, 428/364, 359, 401

(56) References Cited

U.S. PATENT DOCUMENTS

| | | | | |
|---|---|---|---|---|
| 3,005,251 A | | 10/1961 | Hallden, Jr. et al. | 28/1 |
| 3,167,845 A | | 2/1965 | Claussen | 28/1 |
| 3,169,296 A | | 2/1965 | Clendening, Jr. | 28/1 |
| 3,186,155 A | | 6/1965 | Breen et al. | 57/140 |
| 3,380,242 A | | 4/1968 | Richmond et al. | 57/140 |
| 3,454,422 A | | 7/1969 | Mead et al. | |
| 3,457,611 A | | 7/1969 | Nechvatal et al. | 28/1 |
| 3,471,911 A | | 10/1969 | Nechvatal et al. | 28/72 |
| 3,543,358 A | | 12/1970 | Breen et al. | 28/72.12 |
| 3,703,753 A | | 11/1972 | Binford et al. | |
| 3,781,949 A | | 1/1974 | Breen et al. | 28/1.4 |
| 3,854,177 A | | 12/1974 | Breen et al. | 28/1.4 |
| 3,887,972 A | | 6/1975 | Bauch | 28/1.4 |
| 3,899,811 A | | 8/1975 | Bauch | 28/72.12 |
| 3,953,962 A | | 5/1976 | Breen et al. | 57/140 |
| 4,304,817 A | * | 12/1981 | Frankosky | 428/361 |
| 4,319,388 A | | 3/1982 | Champaneria et al. | 28/257 |
| 4,364,996 A | | 12/1982 | Sugiyama | |
| 4,618,531 A | | 10/1986 | Marcus | 428/283 |
| 4,783,364 A | | 11/1988 | Ilan | 428/288 |
| 4,794,038 A | * | 12/1988 | Marcus | 428/288 |
| 5,218,740 A | * | 6/1993 | Snyder et al. | 19/66 R |
| 5,338,500 A | | 8/1994 | Halm et al. | |
| 5,344,707 A | * | 9/1994 | Snyder | 428/459 |
| 5,659,911 A | * | 8/1997 | Kirkbride et al. | 428/401 |
| 5,662,980 A | * | 9/1997 | Howell et al. | 428/97 |
| 5,891,568 A | * | 4/1999 | Hartzog et al. | 428/369 |

FOREIGN PATENT DOCUMENTS

| | | |
|---|---|---|
| DE | 2654332 C3 | 8/1979 |
| JP | HEI 9(1997)-228146 | 2/1996 |

OTHER PUBLICATIONS

G. Fust, New Generation of Fibers for the Interlining Industry, *Technical Textiles*, 41, E36–E38, Sep. 1998.

J. Rupp, New Fibers for Interlinging Materials, *ITB Non-woven Materials–Industrial Textiles*, N/A, 1–3, Apr. 1998.

Dr. J. Brenk, One–Step Inline Staple Fiber Process Offers Producers Greater Flexibility, *IFJ*, N/A, 102–103, Apr. 1998.

Dr.–Ing. J. Brenk, From PP Microfibers to Bicomponent Fibers, *Made–Made Fiber Year Book*, Unknown, 74–76, Sep. 1997.

H. Von Arx, On–Line Spinning—Drawing—Texturing Control, *Chemical Fibers International*, 47, 150, Apr. 1997.

D. Ward (Review), ITMA Reports: MMF Equipment—Easy Routes to Fibre Production, *Textile Month*, Unknown, 15, 17, 20, 34 Dec. 1995.

* cited by examiner

*Primary Examiner*—N. Edwards

(57) ABSTRACT

The present invention relates to surface modified staple fiber, and more particularly, polyester fiberfill and fiber clusters which are made by a completely coupled bulked continuous filament (BCF) process.

6 Claims, 7 Drawing Sheets

STAPLE FIBERS PRODUCED BY A BULKED CONTINUOUS FILAMENT PROCESS AND FIBER CLUSTERS MADE FROM SUCH FIBERS

CROSS-REFERENCE TO RELATED APPLICATION

This application claims benefit of priority from Provisional Application No. 60/139,938, filed Jun. 18, 1999, now abandoned.

FIELD OF THE INVENTION

This invention relates to staple fibers, and more particularly, surface modified polyester staple fibers which are made by a bulked continuous filament (BCF) process, and fiber clusters made from such fibers which can be used as fiber filling material, especially polyester fiberfill.

BACKGROUND OF THE INVENTION

Polyester fiberfill is widely used as a relatively inexpensive filling material for pillows, quilts, sleeping bags, apparel, furniture cushions, mattresses and similar articles. Fiberfill is mostly produced from polyethylene terephthalate crimped staple. A wide range of such staple is available with different deniers, crimp geometry, crimp level, cut length, surface coating, cross-section and other properties. Polyester fiberfill is often coated with a silicone coating such as a polyaminosiloxane slickening agent and sometimes with other non-silicone slickeners, such as segmented polyethylene terephthalate/polyalkylene oxide. Such coatings improve the softness and the hand of the finished article and also contribute to reduce the tendency of the fiberfill to mat (i.e., to clump together) in the article during use. The overwhelming majority of staple filling fibers are carded and cross lapped to form batts which are then used as the filling material. Alternatively, the staple fibers are opened and blown as filling material in a final article.

Another type of filling material is fiber clusters, which are staple fibers which are formed into clusters before being used as a filling material. Contrary to batts made from staple fibers, fiber clusters can move within a ticking in a similar way to down or down/feather blends. Fiber clusters are currently produced from baled spiral crimp staple, made generally by a two step process (polymerization/spinning, then drawing). The staple fibers are first opened, then submitted to a rolling, or tumbling, action on roller cards, flat cards or by rolling against a wall of a cylinder. Known tumbling processes are disclosed in U.S. Pat. Nos. 4,618,531 and 4,783,364. Fiber clusters have gained acceptance in many filling end-uses in the last decade, and with increased volume and improved manufacturing processes, the price of such fiber clusters has slowly come down. However, the manufacture of fiber clusters is still a relatively low throughput and expensive process compared to carded batts, and this hinders further development of the market.

Crimp plays an essential role in the structure of fiber clusters and the ease of their formation. Moreover, crimp determines the filling power, softness and recovery from compression of fiberfill products. Commercial filling fibers may have either mechanical crimp or helical, or spiral, crimp. Mechanical crimp is produced by well known crimper box technology, while helical crimp is produced by asymmetrical quenching or by bicomponent conjugated spinning. Bicomponent conjugated fibers are produced either by spinning two polymers differing only in molecular chain length or by spinning two different polymers or copolymers. The crimp of these fibers results from differential shrinkage between the two polymers or their bicomponent structure when the fiber is exposed to heat. Halm et al., in U.S. Pat. No. 5,112,684, have demonstrated that fiber clusters for filling uses have been prepared from mechanically crimped fibers with specific configurations. Helical fiber clusters having a helical crimp are disclosed by Marcus in U.S. Pat. Nos. 4,618,531 and 4,783,364.

Practice has shown that helical crimp fibers made by asymmetrical quenching or by bicomponent conjugated spinning are the best feed materials for fiber clusters due to the ease of rolling as well as to the highly desired softness, refluffability and recovery from compression of the resulting fiber cluster filling. Feed fibers made by asymetric quenching or by bicomponent conjugated spinning form fiber clusters with spontaneous curling under low forces. Such fiber clusters have a uniform three dimensional entanglement, optimal bulk, and the best balance of softness and recovery from compression, as compared to fiber clusters formed by mechanical crimping. In addition, fibers which exhibit spontaneous curling produce fiber clusters with relatively few fibers sticking out of the fiber cluster, reducing the cohesion between the clusters. Low cohesion is particularly desirable in articles such as pillows and furniture back cushions, since it improves refluffability. Moreover, spontaneous curling not only improves the fiber cluster structure, but it also increases the cluster manufacturing throughput, by reducing the required rolling time.

Fiber spinning speed is typically much faster than the speeds of drawing/cutting and carding/tumbling processes for manufacturing staple fibers and staple fiber clusters. Under current conditions, matching a fiber spinning line with a staple fiber drawing/cutting process and a fiber cluster manufacturing process is very difficult and not economical. The low throughput processes used for producing fiber clusters according to known processes make it impractical to couple fiber spinning and drawing with fiber cluster production. Moreover, the two-step process for manufacturing staple fiber clusters of polymerization/spinning, then drawing/cutting is a complicated and high-cost process, because the uncoupled process requires extra material handling between process steps. In addition, its manufacturing and investment costs are high because it requires additional labor to operate a separate traditional draw machine, which operation is expensive. Moreover, the draw machine itself is expensive.

Thus, there exists a need for developing a simplified process for producing fibers which can be used to make fiber clusters. In particular, it would be desirable to minimize material handling by coupling the entire fiber/cluster manufacturing facility, including the spinning/drawing/cutting steps, as well as the cluster forming steps. Such a process would, ideally, produce low cohesion fiber clusters and would be much simpler and more economical, from a manufacturing standpoint, than the processes of the prior art.

Continuous jet bulking of yarns is widely used to produce carpet yarns, usually from polyamide or polypropylene. Machines for performing such continuous et bulking of yarns are available in the trade from Neumag of Neumunster, Germany, as well as other machine manufacturers. Neumag's standard high-speed continuous staple fiber producing line can produce items based on virtually any polymer, including polyester, as disclosed in "Easy routes to fibre production", ITMA Report: MMF Equipment, *Textile Month*, December, 1995, pp. 15–20. However, it is not known to us e such a line to produce surface modified staple fiber. Nor is it known to use continuous jet bulking for producing polyester staple fiber for use in fiber clusters.

SUMMARY OF THE INVENTION

Applicants have found that polyester staple fibers produced by a bulked continuous filament (BCF) process can form fiber clusters much faster than conventional processes used for making asymetrically quenched or conjugated bicomponent fibers. The structure of such fiber clusters is very similar to the structure of fiber clusters produced from helical fibers, and the filling power of such fiber clusters can be equal to or better than such fiber clusters of the prior art, depending upon the structure of the fiber clusters and the bulking conditions.

Moreover, the BCF process of the present invention enables one to produce fibers with excellent durability and with bulk levels in end products, such as pillows and cushions, which are higher than the bulk levels of products made with cluster of the prior art. Surprisingly, these properties can be achieved under very gently rolling conditions.

Furthermore, the BCF process of the present invention enables one to adjust either the support bulk or the initial height of the end product independently, which is not possible with the prior art. This makes it possible to produce the optimal compression curve for an an end product made from fiber clusters of the present invention.

In addition, the BCF process of the present invention forms fibers at a rate which is much faster than known processes for forming asymmetrically quenched or bicomponent conjugated fibers. In particular, the speeds of the process of the present invention are much faster than those of the prior art. Using the same process conditions for fiber clusters made according to the present invention as compared to fiber clusters made from asymmetrically quenched or bicomponent conjugated fibers, the feed fibers made according to the present invention formed equivalent fiber clusters in two to five times shorter tumbling time. In addition, the process of the present invention allows drawing/crimping and cutting at speeds which are five to twenty times faster than standard spinning/drawing/crimping/cutting technology, resulting in manpower and investment reduction versus traditional routes.

In addition, the availability of small BCF spinning/drawing/bulking units allows further integration of the production of staple fibers and/or fiber clusters from polymer to finished product in a coupled line. The very fast rolling of the feed fibers into fiber clusters helps to match the capacities of spinning/drawing and fiber cluster production, simplifying the process and reducing required investment and manufacturing costs. Moreover, the BCF process of the present invention may be coupled with on-line cutting.

In accordance with the present invention, there is provided a process for producing such fiber. According to this process, a synthetic polymer is spun from a melt of the polymer and cooled to produce solidified continuous filaments. The solidified filaments are drawn as they are advanced by heated rolls. The filaments are jet bulked with a heated dry fluid at a temperature that is above the second order transition temperature of the synthetic polymer and are cooled to below the second order transition temperature of the synthetic polymer. The filaments are cut on line to produce staple fibers. A surface modifer is applied to the fibers. The fibers are then cured. Alternatively, the surface modifier may be applied to the filaments prior to cutting, and then the cut fibers are cured. Also in accordance with the present invention, there is provided a surface modified staple fiber made according to the process of the present invention.

According to another aspect of the present invention, there is provided a surface modified staple fiber. The fiber has a three-dimensional curvilinear random primary crimp. Preferably, the staple fiber is of 2 to 20 dtex and has a cut length of 10–100 mm. The fiber has a secondary crimp with a frequency of more than 6 crimps per 10 cm length. According to another aspect of the invention, there are provided three-dimensional, randomly entangled fiber clusters produced from such fiber.

DETAILED DESCRIPTION OF THE INVENTION

Figure 1:
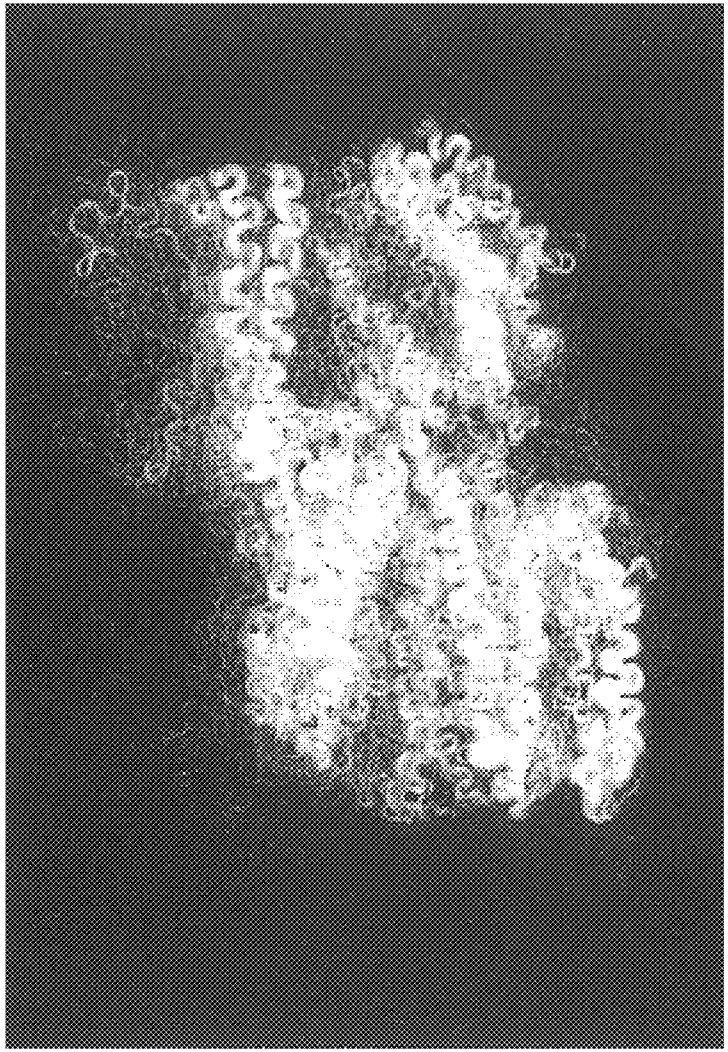
FIG. 1 (PRIOR ART)
FIG. 1 is a photograph showing a fiber bundle of the prior art having helically crimped staple fibers.
Figure 2:
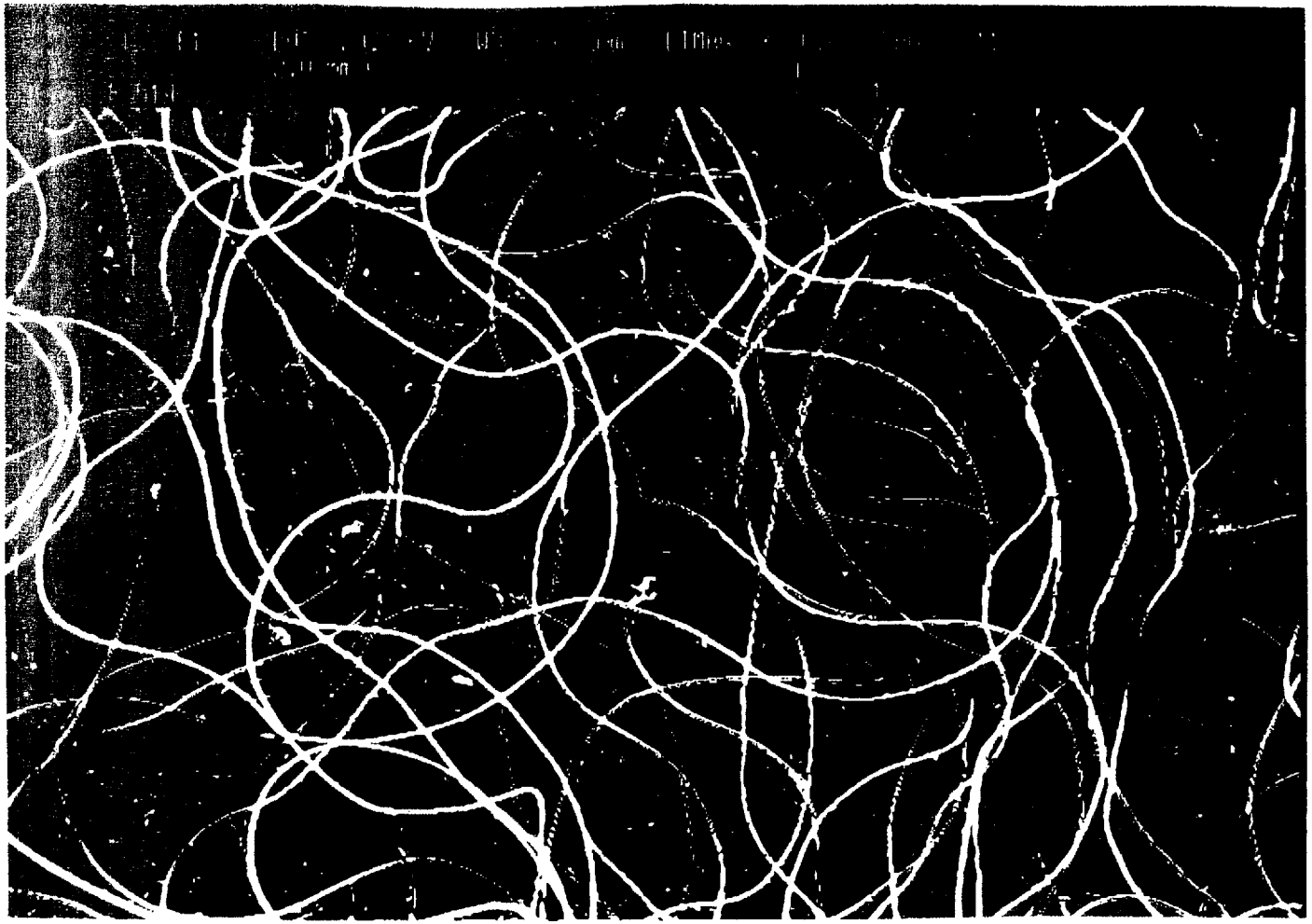
FIG. 2 (PRIOR ART)
FIG. 2 is a photograph showing a plurality of the helically crimped staple fibers of the fiber bundle of FIG. 1.

FIG. 1 is a photograph showing a fiber bundle of the prior art where the fibers, a plurality of which are shown in FIG. 2, have a helical crimp. The fibers of FIG. 2 are asymmetrically quenched staple polyester fibers, commercially available from DuPont Sabanci Polyester GmbH as Type 234/688. As can be seen from FIG. 2, the asymmetrically quenched fiber of the prior art has a smooth wavy primary crimp.

Figure 3:
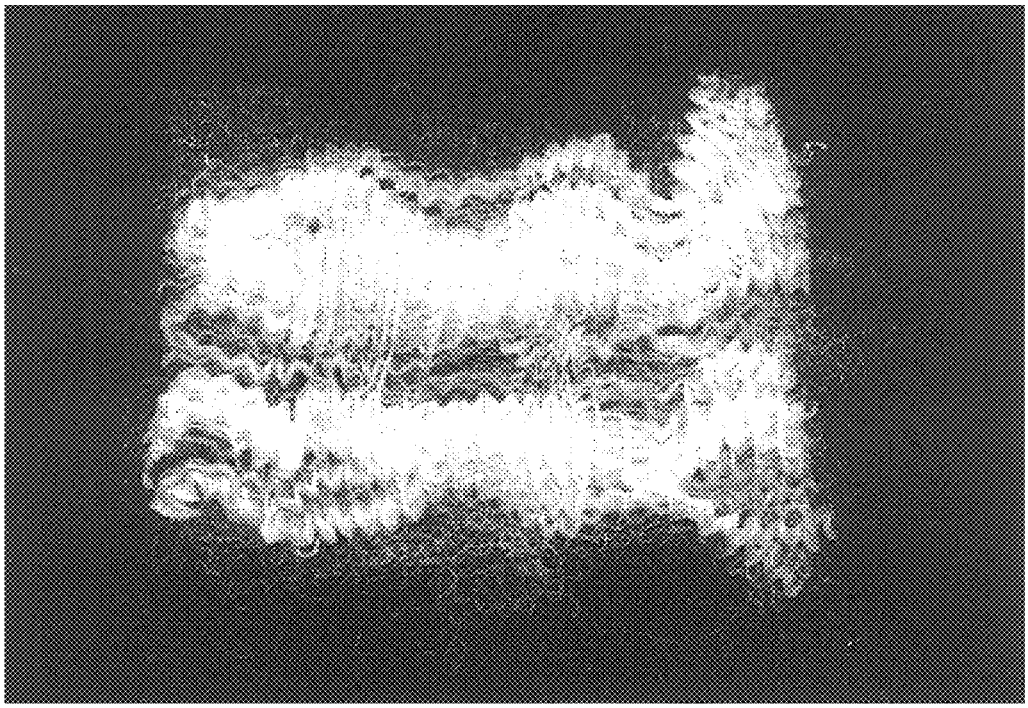
FIG. 3 is a photograph showing a fiber bundle of the prior art having mechanically crimped staple fibers.
Figure 4:
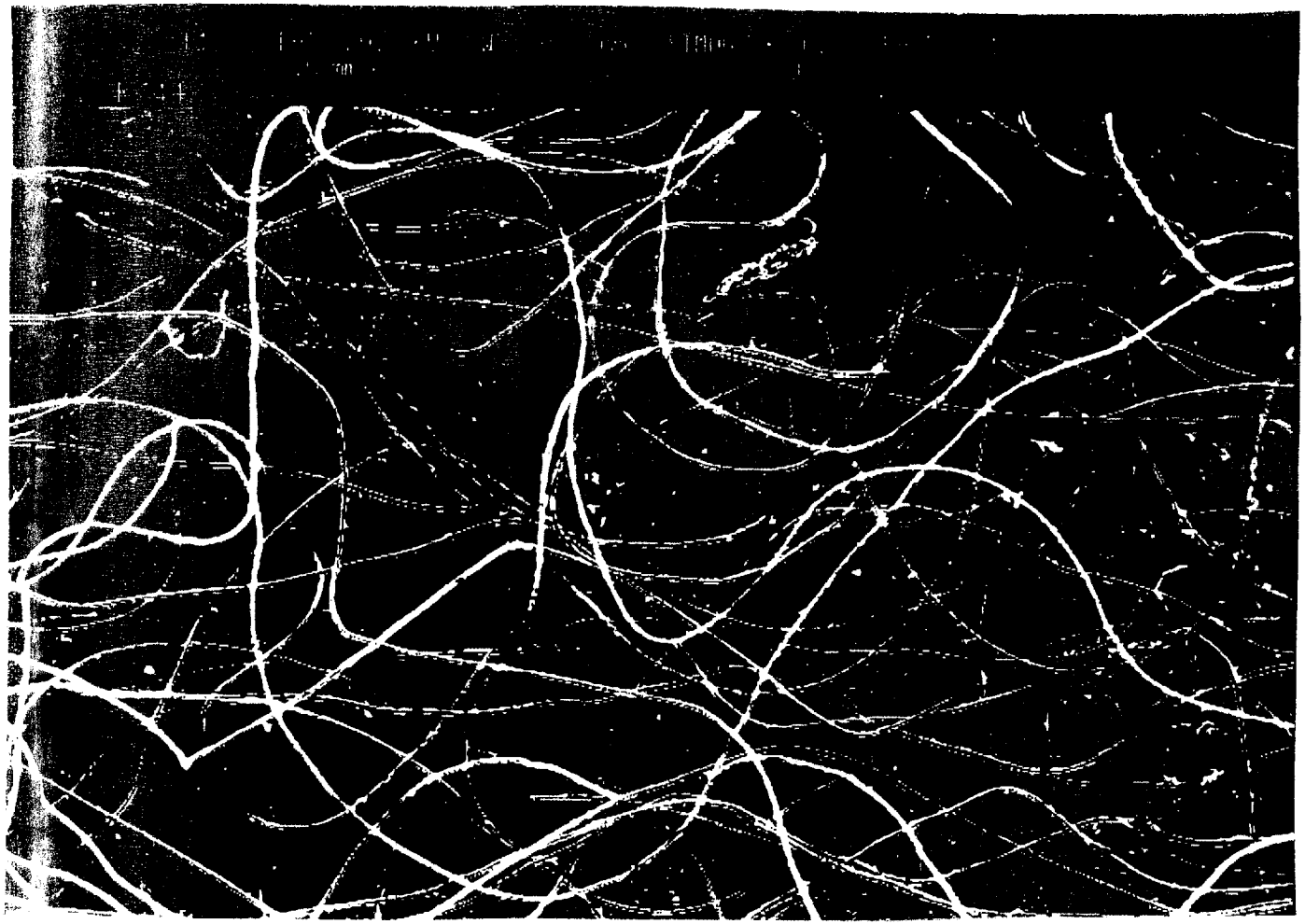
FIG. 4 (PRIOR ART)
FIG. 4 is a photograph showing a plurality of the mechanically crimped staple fibers of the fiber bundle of FIG. 3.

Another fiber bundle of the prior art is shown in FIG. 3, this time where the fibers, as shown in FIG. 4, are mechanically crimped. The polyester staple fiber of FIG. 4 is commercially available from DuPont Sabanci Polyester GmbH as Fiberfill Type 514 and sold under the trademark QUALLOFIL®. Again, the primary crimp of such prior art fiber can be characterized as being smooth and wavy, as can be seen from FIG. 4.

Figure 5:
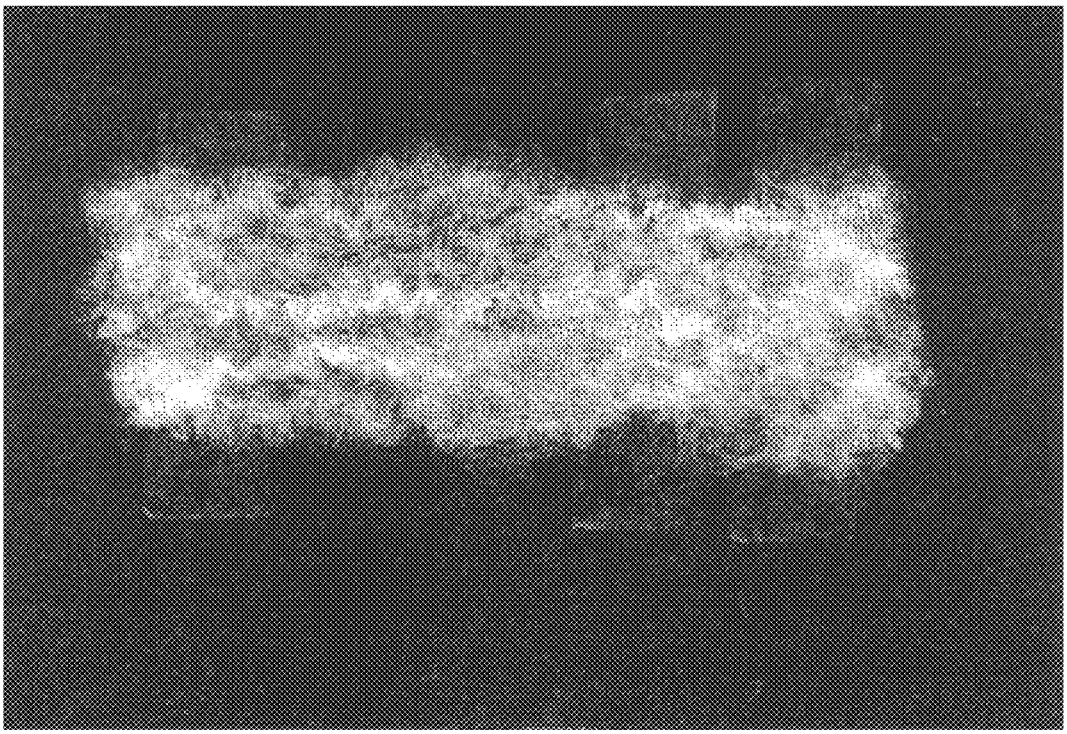
FIG. 5 is a photograph showing a fiber bundle comprising staple fibers having a three-dimensional curvilinear random primary crimp in accordance with the present invention.
Figure 6:
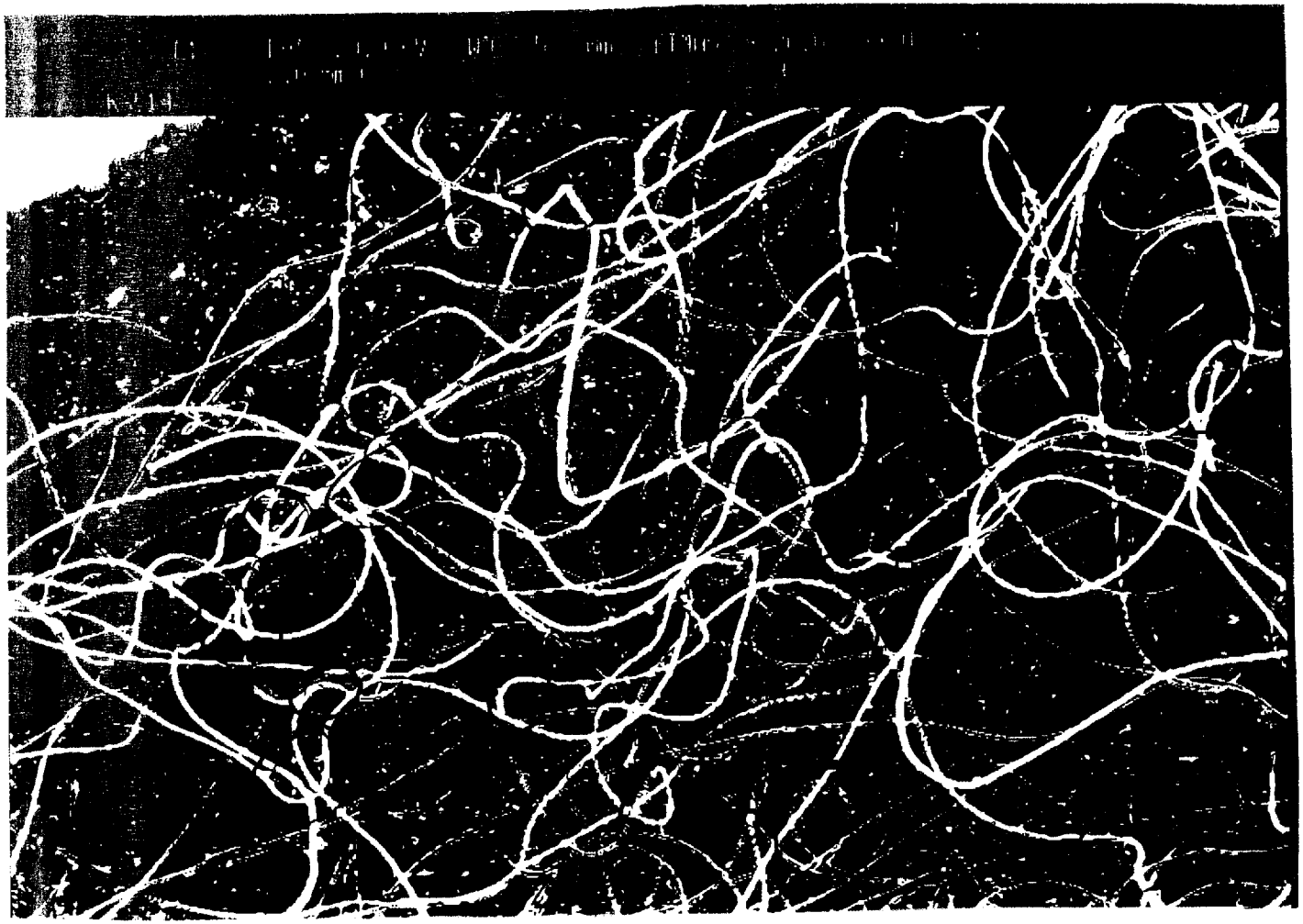
FIG. 6 is a photograph showing a plurality of the staple fibers of the fiber bundle of FIG. 5.

The present invention is directed to a surface modified staple fiber having a three-dimensional curvilinear random primary crimp. A fiber bundle of fibers of the present invention is shown in FIG. 5, with a plurality of the fibers being shown in FIG. 6. The fibers shown in FIG. 6 are BCF hollow polyethylene terephthalate fibers having a cut length of 25 mm. The primary crimp shows very frequent changes in amplitude and frequency, as well as orientation in space of the individual filaments, while the secondary crimp is more regular in amplitude and frequency. Alternatively, the fibers of the present invention may be described as having high and low frequency primary crimp.

The surface modified staple fiber of the present invention is preferably of 2 to 20 dtex and preferably has a cut length of 10–100 mm. The fiber is preferably polyester, although it is not limited to this material. In addition, the fiber preferably has a secondary crimp with a frequency of more than 6 crimps per 10 cm length.

Blends of fibers according to the present invention may be made with other fibers, including binder fibers. In such blends the fibers comprise at least 70% of the weight of the blend.

The term "surface modified" as used herein means that the surface of the fiber is coated with a material, and that the coating adheres to the fiber for some period of time. The staple fibers of the invention can be surface modified with a silicone polymer, such as polydimethyl siloxane with % Si from 0.02 to 1.0% per weight of the fibers. The staple fibers of the present invention may alternatively be surface modified with other surface modifiers which may be advantageous in some applications, such as segmented copolymers of polyalkyleneoxide and other polymers, such as polyester, or polyethylene or polyalkylene polymers, with the weight percent of the surface modifier being from about 0.1 to about 1.2% per weight of the fibers. The surface modifiers discussed in this paragraph bond well to binder fibers and promote moisture transport, which can be important for applications such as non-wovens articles and fiber clusters produced from blends of the fibers of the present invention and binder fibers.

Non-woven articles can be produced from the fibers of the present invention, and in particular, from the fibers of the present invention which are surface modified with segmented copolymers of polyalkyleneoxide and polyester.

Further in accordance with the present invention, there are provided fiber clusters, each cluster having a random distribution and engtanglement of the fibers. The fiber clusters comprise surface modified staple fibers of the present invention as discussed above. Surface modification of the fibers with a silicone polymer, or other polymeric coating as described above, which reduces fiber-to-fiber friction, usually helps to roll the fibers under milder conditions, which results in a higher bulk, softer end product and a uniform distribution of the fibers in the fiber cluster.

Preferably, the fiber clusters have an average diameter of from about 2 to about 15 mm. The fiber clusters of the invention are preferably round and have a uniform density and a three-dimensional structure. At least 50% by weight of the fiber clusters have a cross-section such that the maximum dimension of each fiber cluster is not more than twice the minimum dimension. The fiber clusters can also be made of a mix of deniers by producing fibers with different deniers where the fibers of different deniers are blended during the spinning process or the drawing process.

The fibers clusters of the present invention are refluffable. With the present invention, the number of filaments extending from a fiber cluster is relatively small. This ensures a relatively low cohesion and good refluffability.

Fiber clusters in accordance with the present invention may comprise a fiber other than the staple fiber of the present invention. This other fiber may comprise up to 30%, by weight, of the total fibers in the fiber cluster.

Either the fibers or the fiber clusters of the present invention may be used to fill articles such as pillows, quilts, furniture cushions, sleeping bags, apparel and similar articles. Such fiber clusters are good materials for molded structures as disclosed in U.S. Pat. Nos. 5,169,580, 5,294,392 and 4,940,502.

Figure 7:
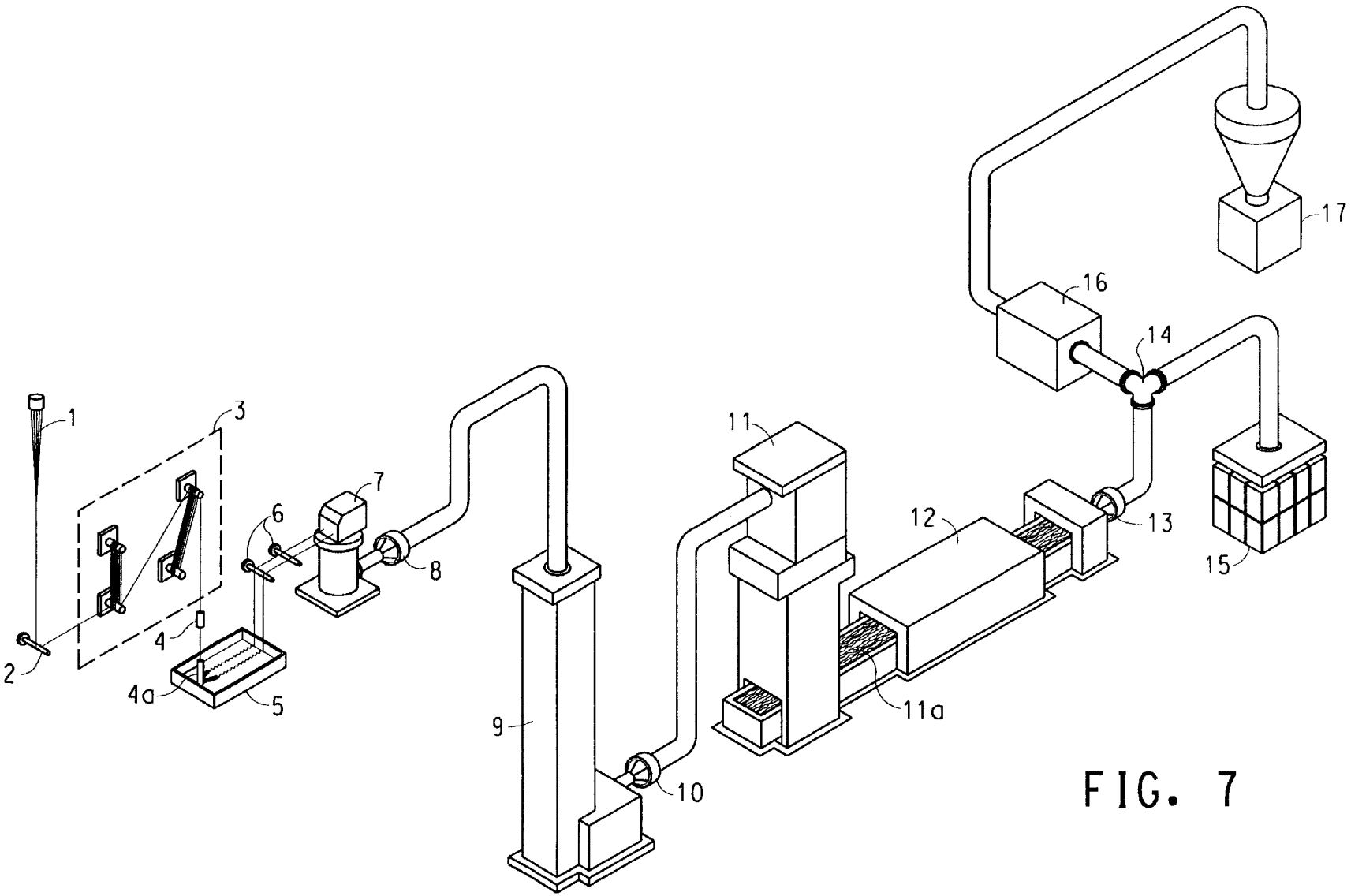
FIG. 7 is schematic representation showing the overall process of the present invention.

Further in accordance with the present invention, there is provided a process for producing staple fiber. The process of the present invention will be described with respect to FIG. 7. This staple fiber is described above. The process of the present invention comprises the step of spinning a synthetic polymer from a melt of the polymer and cooling the polymer to produce solidified continuous filaments. Reference is made to FIG. 7, which shows the solidified continuous filaments, or a spun yarn supply 1, emerging from a spinning position (the spun yarn supply may come from one or more spinning positions). The process further comprises the step of drawing the solidified filaments as the solified filaments are advanced by heated rolls. This step is illustrated in FIG. 7, where the spun yarn supply is conveyed by a guide 2 to a drawing module 3, which includes one or more pairs of heated draw rolls. It should be noted that the solidified filaments may be drawn in one or more drawing steps. Drawing speeds for the present invention may be up to 4000 m/minute versus standard drawing speeds of 150 to 400 m/minute.

The process of the present invention further comprises the step of jet bulking the filaments with a heated dry fluid at a temperature that is above the second order transition temperature of the synthetic polymer. This step is performed in stuffer jets, shown at 4 in FIG. 7. An example of a commercially available machine which is suitable for running the process of the present invention is the 3D Machine, produced by Neumag of Neumunster, Germany. This machine corresponds to elements 3, 4 and 7 of FIG. 7. A description and photographs of Neumag's lab machine were published in IFJ, Apr. 1, 1998, pp. 102–103.

A stuffer jet generally has two portions, an upper portion where the steam is injected, and a lower portion, which is a stuffing chamber. Support bulk is formed in the upper portion of the jet, and is essentially dependent on primary crimp, while the secondary crimp is formed in the stuffing chamber. The random primary crimp of the fibers of the present invention plays an important role in the consolidation of the fiber cluster structure by locking the fibers, reducing their ability to slide one on top of the other, which results in a consolidation of the fiber cluster structure. As a result, the fiber clusters of the invention have an improved resilience and durability.

Also, the stuffer jets used with the present invention are very flexible and allow adjustment of the support bulk to specific end-use requirements. With asymmetric quenched and conjugated bicomponent fibers it is much more difficult to adjust and control bulk.

In addition, the specific bulk characteristics formed by the stuffer jets produce the spontaneous curling effect exhibited by the fiber clusters of the present invention. This spontaneous curling effect plays an essential role in the ease of formation of the fiber clusters of the present invention.

For making fibers from polyethylene terephthalate, injecting steam in the stuffer jet is clearly preferable over injecting hot air. The use of steam at 200–235° C. in bulking, combined with annealing prior to bulking, produces a permanently set crimp with excellent resilience. Moreover, by using steam with the present invention, fiber clusters having 10–15% higher filling power, and equal bulk losses, as compared to fiber clusters made according to the prior art, have been achieved.

The bulked filaments are laid down with a lay down spout by rotating guides 4*a* on a perforated belt 5, which transports the bulked yarn through a cooling zone, shown near belt 5 in FIG. 7. Alternatively, instead of being laid down, the bulked yarn may be projected against a screen. The bulked filaments are cooled to below the second order transition temperature of the synthetic polymer. This step is performed in the cooling zone. In a preferred embodiment, where steam is used, the filaments are cooled to a temperature below 50° C. From the cooling zone the filaments are passed through guides 6 to control their tension prior to cutting with a high speed cutter 7. It should be noted that rotating guides 4*a*, belt 5 and the cooling zone may have different designs than that shown in FIG. 7. For instance, the belt may be replaced by a rotating perforated drum without affecting the essence of the invention.

The process of the present invention further includes the step of cutting the filaments to produce staple fibers. The BCF process of the present invention may be coupled with on-line cutting. This coupled BCF and on-line cutting process enables drawing/crimping and cutting at speeds which are five to twenty times faster than standard spinning/drawing/crimping/cutting technology. Specifically, cutting on-line may be done at speeds of 1800 m/min to 4000 m/min.

Further in accordance with the process of the present invention, a surface modifier is applied to the staple fibers to produce surface modified staple fibers. As can be seen from FIG. 7, the staple fiber is transported by a fan 8 to a silo 9 which regulates the flow and serves as a buffer in case of filament breaks in spinning or drawing. From silo 9 the staple fiber is transported by a fan 10 to a surface modifier applicator 11. The staple fiber is conveyed by an air stream or a roll with teeth or needles and passed in front of a plurality of jets to apply the surface modifier. It should be noted that the surface modifier may be applied to the filaments prior to cutting. However, due to the high speed of the drawing and bulking processes, curing of the surface modifier on the filaments prior to cutting, which is done at 1800–4000 m/min, may be impractical because of the length of the oven which is required for curing and the difficulties in the take-off from the belt of the multiple layers of cross-laid filaments. Cutting of the surface modified fibers without curing may also cause deposits on the cutter and on any surface which may be in contact with the fibers.

The process of the present invention further includes the step of curing the surface modified fibers. As can be seen from FIG. 7, after the surface modifier has been applied, fibers are then laid down on an oven belt 11*a* for curing. This oven belt carries the material through an oven 12 for drying and curing, accomplished by conventional techniques. From the oven belt the staple fiber is transported by a fan 13 via a valve 14. The cured fibers are either baled for later processing in a baler, such as baler 15 as shown in FIG. 7, or the fibers are used directly in a coupled process for producing fiber clusters, non-wovens or similar products. The fibers are directly processed by cluster forming (i.e., rolling) equipment, which is shown at 16 in FIG. 7. The fibers are folled into fiber clusters in the cluster forming equipment. This direct use of fibers for producing fiber clusters is preferable as this single step, coupled process simplifies the process of cluster making and minimizes production costs. From the rolling equipment the fiber clusters are transported to a packaging unit 17. For practical reasons, such as yarn breaks or equipment cleaning, it is preferable to have a silo as a buffer system between the cluster forming equipment and the textile operation. It should be noted that the rolling equipment may be replaced by other textile processing equipment, such as equipment for producing non-wovens or battings.

Tumblers suitable as the cluster forming (i.e., rolling) equipment for the present invention are disclosed in U.S. Pat. Nos. 4,618,531 and 4,783,364. Although the present invention is not limited to any specific equipment for rolling the fibers into fiber clusters, a tumbling process was found advantageous due to the ease with which the physical properties of the fiber clusters can be controlled by changing the rpm or the cycle time. However, modified flat and roller cards, or any other equipment which allows a controlled rolling of the fibers may also be used to produce the fiber clusters of the invention. In general, all the processes which can be used to produce fiber clusters from asymmetric quenched or conjugated bicomponent fibers could be used for the present invention. When the rolling is done by certain types of tumblers the size of the fiber clusters according to the invention can be controlled by the cut length of the fibers, their bending modulus and bulk, by the rolling force applied, and by the control of the dimensions of the fiber tufts prior to rolling.

The process of the present invention produces fiber clusters of comparable bulk and cluster formation in shorter time or under milder rolling conditions than fibers of the prior art. In general, the tumbling time achieved by the present invention may be one-half to one-fifth the processing time of the prior art. This fast rolling allows one to significantly increase productivity and reduce manufacturing costs. As a result of the shortened rolling time of the present invention, it is possible to couple a commercial compact spinning/drawing/cutting machine, such as the Neumag 3D Machine, with fiber cluster production equipment. Thus, with the present invention it is possible to produce fiber clusters in a coupled process from polymer to ready-to-use fiber clusters without packing and storing any intermediate product, thus significantly simplifying the fiber production process and minimizing materials handling. Moreover, this coupled continuous process can achieve drawing speeds of up to 4000 m/minute, versus standard drawing speeds of 150 to 400 m/minute, resulting in manpower and investment reduction versus traditional routes.

Jet design, yarn temperature at the entrance of the jet, yarn dtex, filament thickness and cross section, fluid temperature and pressure are the main parameters which influence the crimp characteristics and determine the ease of rolling of a given fiber. With the appropriate adjustment of the jet design and operating conditions the bulked continuous filament process of the present invention delivers an outstanding feed fiber for fiber cluster production. Depending on the process parameters, the fibers may be completely separated having essentially no unopened chips and no need to pre-open the fibers prior to rolling. Thus, in a coupled process the need for a fine opener prior to further processing, such as rolling into fiber clusters, can sometimes be avoided. The fibers are separated into individual filaments so that when used as feed fibers for fiber clusters they are free to form a three dimensionally entangled fiber cluster where all fibers fully contribute to bulk and recovery. This contributes further to simplify the manufacturing process of the invention.

Another advantage of the present invention is the flexibility of modifying initial bulk (loft) with little impact on the support bulk and vice versa. This allows one to adjust the compression curve of the finished product filled with the staple fibers or the fiber clusters and is directly related to the process conditions for drawing and bulking. This flexibility in modifying the initial and support bulk makes the fiber cluster manufacturing process of the present invention an outstanding process for coupling fiber production with fiber cluster production or other textile processes. In a coupled process, gradual adjustments of bulk with a short response time are a must to control quality within established limits. In such a coupled, high-productivity process, it is essential to have high flexibility to adjust product properties at both the step of fiber production and the step of transforming the fiber into fiber clusters. The BCF process of the present invention offers these fast-reacting control tools on the fiber production end, while a tumbler process can offer similar tools and flexibility on the fiber cluster production end.

The invention is further described by the following Examples, which are intended to be exemplary only and not limit the invention.

DESCRIPTION OF TEST METHODS

The following test methods were used in the Examples of the present invention.

Cylinder Bulk Measurements

This method measures the compression characteristics of fiber clusters or other cluster products in a way which is very similar to the measuring of the filling power of feather and down. With this method, 300 g of a loose material, such as fiber clusters, are placed carefully into a 500 mm high, 290 mm diameter cylinder, and the material is pressed with a 640 square cm foot at the speed of 100 mm/minute until the maximal pressure of 120 N is achieved. Then the foot moves up immediately to release the material. The objective of the first compression is only to make material uniform and eliminate the false bulk; the measurements are done during the second compression. The height under given pressures measures the characteristics of the material.

Bulk measurements on cushions

Bulk measurements are made conventionally on an Instron machine, commercially available from Instron Corporation of Canton, Mass., to measure the compression forces versus the height of the sample cushion, which is compressed with a foot of 10 cm diameter attached to the Instron. The cushion is first compressed once increasing the force up to 60 N, then released and compressed again. The height under the compression force during the second compression cycle is reported in Table 2, below. Initial Height ($IH_2$) is the height at the beginning of the second compression cycle, and the height at 60 N is the cushion height under 60 N in the second compression cycle.

EXAMPLES

In the following Examples all fibers were polyester fibers produced from polyethylene terephthalate. All feed fibers used for the production of the fiber clusters in the Examples of the invention were produced on a pilot plant 3D Machine at Neumag (Neumunster, Germany). The equipment used for the production of fiber clusters was a Lorch Model ML 10S, which is available from Lorch AG, of Esslingen, Germany.

COMPARISON A

Polyester staple fiber, of 5 dtex, of cut length 32 mm, of solid, round peripheral cross-section, slickened with 0.6% silicone slickener, and of helical crimp that had been produced by asymmetric jet quenching of filaments spun from virgin polymer, was opened using a Laroche opener, available from Laroche SA of Course La Ville, France. The fiber was then passed through a Trutzschler (Clean-Master) beater, available from Trutzschler GmbH & Co. KG of Monchengladbach, Germany, to tear the staple into appropriately-sized tufts. 10 Kg of these tufts were blown into an air-tumbling machine (i.e., a Lorch having a diameter of 127 cm and a length of 449.5 cm) to form fiber clusters by tumbling at 320 rpm for 75 seconds, followed by 75 seconds in the other direction (150 seconds total). The fiber clusters were collected by sucking them out of the air-tumbling machine and into a woven polypropylene bag. The bulk of the product was then measured by the cylinder bulk method.

Example 1

Polyester staple fiber, of 6.7 dtex, of cut length 32 mm, of solid, round peripheral cross-section, slickened with 0.6% silicone slickener, and having heat-set filament crimps random, three-dimensional, curvilinear, extensible configurations produced by BCF heat-setting bulking as described hereinafter, was passed through a bale-breaker and a Laroche opener, and then through a Trutzschler Clean-Master with the chamber kept open, in order to break at least partially the fiber chunks. The whole load (amounting to 8.5 Kg, which was all that was available in contrast to a standard load of 10 Kg) was blown into the same air-tumbling machine as used in Comparison A, and processed at 320 rpm. In Example 1, however, this BCF fiber only needed processing for 10 seconds in each direction (20 seconds total) in contrast to 75 seconds needed for Comparison A that used spiral crimp feed fiber. In other words, Comparison A took 7.5 times the time taken to make fiber clusters in Example 1.

The polyester staple fiber used in Example 1 was made and bulked as follows. Polyester flakes (recycled polymer of IV 0.61 as opposed to virgin polymer used for Comparison A) were dried for 15 hours and spun into round (solid) filaments through 542 capillaries at a throughput of 33.2 Kg/hr (2 positions, each of 271 capillaries), using a polymer temperature of 296° C., a withdrawal speed of 380 m/min and immediately drawn (spin-drawing) with 3 sets of draw rolls, as follows: 1–418 m/min (1.1×) at 90° C.; 2–1806 m/min (4.3×) at 160° C.; 3–1766 (let-down, 50 m/min) at 170° C.; jet bulked using steam at 220° C. and 8.0 bars pressure; then slickened at a speed of 1590 m/min using a series of jets applying the same polydimethyl siloxane-type slickener for Comparison A to provide the same slickener level (0.6%), and cut to staple at 1590 m/min. The slickener on the staple was cured by passing the staple in vacuum-packed bags through an oven on a belt for at least 10 minutes at 170° C.

Example 2

The feed fibers used in Example 2 were the same as those used in Example 1, but the processing into fiber clusters was modified to demonstrate the effect of at least partial elimination of fiber chunks. The fibers were processed through a bale breaker and a Laroche Opener, then passed through a Clean-Master before being processed in a Lorch tumbler under the same conditions as in Example 1. The load was 9.0 kg versus 8.5 kg in Example 1, while the standard load was 10, as in Comparison A. The reason for this deviation was the limited availability of the fiber. The processing of the fibers prior to rolling in this Example produced a product with a very substantial reduction in the number of tails, an improvement in the structure of the fiber clusters and an increased bulk, matching the bulk of Comparison A, as can be seen from Table 1. The filling power (bulk under low loads) of the product in Example 2 was equal to Comparison A, and the support bulk (height at 120N) was about 10% higher.

Example 3

Hollow polyester fiber, of 6.0 dtex, of cut length 32 mm, and similarly slickened and crimped were prepared similarly, except as follows: the fibers were spun from polymer of IV 0.62 (melted from flakes of virgin polymer) through 560 capillaries having a "C shape", so as to produce a slightly off-center hollow filament with about 10% void content, at a withdrawal speed of 450 m/min and the first set of draw rolls (at 90° C.) was at a speed of 468 m/min (1.04×, the second stage draw ratio being only 3.9×), and the steam pressure used for jet bulking was 8.5 bars (230° C.).

These fibers (4 Kg) were processed, as in Example 1, through the Trutzschler Clean-Master, again with the chamber kept open and in the same air-tumbling machine (the Lorch as described in Comparison A) (at 320 rpm) for 75 seconds (total) without changing direction. The fiber clusters were then sucked into a woven polypropylene bag.

The bulk of each of the fiber cluster products of the above experiments was measured in a cylinder as follows and the results are given in Table 1 below.

The fibers of this Example 3 required a longer time or a higher rpm to achieve a fiber cluster structure comparable to the structure of Example 2. This can be attributed to the very high crimp level of the fibers of Example 3. This can be seen in the higher bulk of the resulting fiber clusters of Example 3 as shown in Table

TABLE 1

| | HEIGHTS IN MM UNDER LOADS | | |
|---|---|---|---|
| EXPERIMENT | IH2 | 5N | 120N |
| Comparison A | 353 | 315 | 103 |
| Example 1 | 337 | 299 | 107 |
| Example 2 | 350 | 317 | 113 |
| Example 3 | 404 | 371 | 130 |

It will be noted that the bulk values (heights) for the product of Example 3 were always the best, being far superior than those obtained for the commercial product used for Comparison A. The Initial Heights at the beginning of the second compression cycle (IH2) were comparable for the commercial product and for the product of Example 1 (made by air-tumbling in only 20 seconds, as opposed to 2½ minutes), but the height (bulk) was significantly higher for the product of Example 1 under maximum load. In other words, the comparative measurements in Table 1 show that superior initial bulk can be obtained from fiber clusters of the present invention over that obtained with the present commercial product and that the support bulk provided by fiber clusters of the present invention can also be better.

It is important to note also the following significant factors that would have affected the Examples according to the invention, namely the vacuum packing and shipping of the products from where the feed fibers were made and bulked to where the air-tumbling was performed, the relatively small quantities of fiber and of fiber clusters produced and the consequent lack of opportunity to optimize processing conditions in contrast to the commercial product which has been made for several years during which process and product have been optimized, and the fact that Example 1 was made from recycled polymer, and not of virgin polymer that had not been made from recycled intermediates.

Bulk measurements were made on two cushions made from the fiber clusters produced as described above, with the following exceptions noted. Both cushions were of the same size (50×50×10 cm). Comparison B used fiber clusters made essentially as described for Comparison A except that the air-tumbling machine was operated at 360 rpm to achieve a commercial product having about 5–7% lower Initial Height and increased support bulk (firmness) that is desirable for furniture cushions. The cushion for Comparison B was filled with 675 g of this commercial product. Since the product of Example 3 had higher bulk, only 574 g were filled into this cushion, i.e,. 15% less than the 675 g used for the commercial product. As can be seen from Table 2, the cushions from Example 3 according to the invention had higher bulk despite the lower filling weight, i.e., were significantly lighter and more bulky.

TABLE 2

| | Heights in mm under Loads | |
|---|---|---|
| | Comparison B | Example 3 |
| Initial Height (IH2) | 146 | 150 |
| Height at 2.5 N | 136 | 141 |
| Height at 7.5 N | 117 | 124 |
| Height at 15 N | 98 | 105 |
| Height at 60 N | 45 | 50 |

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A surface modified staple fiber comprising a three-dimensional curvilinear random primary crimp.

2. The surface modified staple fiber of claim 1, wherein the fiber is of 2 to 20 dtex and has a cut length of 10–100 mm, and further wherein the fiber is characterized by a secondary crimp with a frequency of more than 6 crimps per 10 cm length.

3. A fiber according to claim 1, wherein the fiber is surface modified with a silicone polymer.

4. The fiber according to claim 1, wherein the fiber is surface modified with segmented copolymers of polyalkyleneoxide and other polymers or polyethylene or polyalkylene polymers, wherein the weight percent of the surface modifier is about 0.1 to about 1.2% per weight of the fiber.

5. A surface modified staple fiber comprising a three-dimensional curvilinear random primary crimp according to claim 1, wherein the fiber is made by a process comprising the steps of:

(a) spinning a synthetic polymer from a melt of the polymer and cooling the polymer to produce solidified continuous filaments;

(b) drawing the solidified filaments as the solidified filaments are advanced by heated rolls;

(c) jet bulking the filaments with heated dry fluid at a temperature that is above the second order transition temperature of the synthetic polymer;

(d) cooling the filaments to a temperature below the second order transition temperature of the synthetic polymer;

(e) cutting the filaments on-line to produce staple fibers each comprising a three-dimensional curvilinar random primary crimp;

(f) applying a surface modifier to the fibers to produce surface modified fibers and (g) curing the surface modified fibers.

6. A fiber according to claim 3, wherein the silicone polymer is polydimethyl siloxane with % Si from 0.02 to 1.0% per weight of the fiber.

* * * * *